United States Patent [19]

Spiertz et al.

[11] 4,125,401

[45] Nov. 14, 1978

[54] METHOD OF MAKING COPIES OF INFORMATION TRACKS ON CARRIERS

[75] Inventors: Elisabeth J. Spiertz; Christiaan F. W. Flinsenberg; Leendert K. H. van Beek, all of Eindhoven, Netherlands

[73] Assignee: U.S. Philips Corporation, New York, N.Y.

[21] Appl. No.: 774,192

[22] Filed: Mar. 3, 1977

[30] Foreign Application Priority Data

Oct. 20, 1976 [NL] Netherlands ..... 7611567

[51] Int. Cl.[2] ..... G03C 5/24; G03C 1/58

[52] U.S. Cl. ..... 96/49; 96/27 E; 96/48 PD

[58] Field of Search ..... 96/49, 48 PD, 27 E, 96/27 R, 35.1, 36, 35; 358/130, 132, 8

[56] References Cited

U.S. PATENT DOCUMENTS

| | | | |
|---|---|---|---|
| 3,381,085 | 4/1968 | Johnson et al. | 358/8 |
| 3,687,664 | 8/1972 | Broadbent | 96/35.1 |
| 3,925,080 | 12/1975 | Postma | 96/48 PD |

FOREIGN PATENT DOCUMENTS

| | | | |
|---|---|---|---|
| 1,227,116 | 4/1971 | United Kingdom | 96/48 PD |
| 1,391,541 | 4/1975 | United Kingdom | 358/8 |

OTHER PUBLICATIONS

Jerome, et al., Journal of the SMPTE, vol. 83, #7, 7/1974, paper presented 4/1974, pp. 560–563.

*Primary Examiner*—Won H. Louie, Jr.
*Attorney, Agent, or Firm*—Frank R. Trifari; Norman N. Spain

[57] ABSTRACT

Copying by photographic means of plates having coded audio and video information of a very fine structure. Use is made of an aromatic diazosulphide as light-sensitive system, wherein, after exposure, a metal nuclei image is produced by contact with metal salt, which metal nuclei image is at or below the surface and which is intensified by means of physical development to an externally reflective and, as such, readable image.

1 Claim, No Drawings

METHOD OF MAKING COPIES OF INFORMATION TRACKS ON CARRIERS

The invention relates to a method of making copies of information tracks on carriers, more specifically of information carriers of a spiral structure, in which sound and/or video information is stored in the form of frequency-modulated or phase-modulated signals and which structure is assembled from blocks of a variable length which lie in the same plane, separated by areas of a variable length which also lie in a same plane. This kind of information tracks which are described in United Kingdom Patent Specification No. 1,391,541 has a very fine structure; in practice the length of said blocks is in the order of 1 μm and their width is approximately 0.3 μm.

From U.S. Pat. Specification No. 3,381,085 it is known to make copies by photographical means of information tracks to which coded pictures are applied in the form of a spiral track with variable light transmission, which is written by means of a modulated electron beam. Such an information track has a rather coarse structure. Reproduction thereof by photographic means furnishes no difficulties whatsoever.

It appeared, however, that information tracks of the kind described in United Kingdom Patent Specification No. 1,391,541 cannot be copied by photographic means without additional measures.

Dispersion of light during exposure and the occurrence of deflection phenomena may result in annoying background noise.

The usual photographic emulsions on the basis of silver halide are too coarse-grained to enable the reproduction of the fine details of the information track without loss. Even emulsions of this kind with a very fine grain, the so-called Lippman emulsions appeared to be unsuitable for this purpose.

The occurrence of deflection phenomena, which is associated with the fact that the wavelength of the light used for making the copy is of the same order of magnitude as the pictures to be copied was experienced as annoying with various systems, among which some molecular dispersion light-sensitive systems, such as material containing an aromatic diazosulphonate and which, after exposure, is brought into contact with a solution containing mercurous ions and, optionally, silver ions, which results in mercury or silver amalgam nuclei which can be physically developed. Apart from this it appeared that the diazosulphonates were insufficiently diffusion-resistant so that a large part of the definition of the original would have got lost.

In addition it is actually far from obvious to make copies by photographic means of information tracks of the above-mentioned kind, such as, for example, obtained in accordance with the method described in United Kingdom's Patent Specification No. 1,447,066. In accordance with this method there is applied to an information carrier of disc form a photoresist which, due to rotation of the disc relative to a punctiform radiation source, a radiation beam supplied by a laser in particular is intermittently exposed and not exposed during the variable periods which correspond to the information whereafter the photoresist is developed and the required information track is etched.

Thus the information track consists of an embossed picture. If a reproduction is made hereof by photographic means a picture is obtained in the carrier which extends across substantially the entire thickness of the carrier. It is far from certain that hereby the entire video and sound information would be fully transmitted.

Dutch Patent Application No. 7,609,610 which has not yet been published describes a method in accordance with which copies of information carriers having an information track of spiral or of concentric circular form wherein sound and/or video information in the form of frequency-modulated or phase-modulated signals is stored in the form of blocks of a variable length which lie in the same plane, separated by areas of a variable length, which are also in a same plane are obtained by means of the photographic system which is known per se from United Kingdom Patent Specification No. 1,227,116. Herein use is made of light-sensitive material consisting of a substrate layer which comprises a light-sensitive compound which is of the type which furnishes after exposure a light-reaction product which is able to react with mercurous ions in the presence of moisture and, preferably, also in the presence of silver ions whilst separating mercury or silver amalgam which is deposited in the form of a metal nuclei image which can be physically developed, which light-sensitive compound is an aromatic diazosulphide of the structure

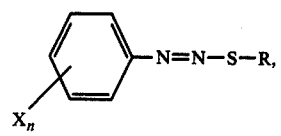

wherein the benzene ring may comprise one or more substituents X and wherein R is a whether or not branched alkyl or aralkyl group, by developing until a density below D = 1 above the basic density of the carrier.

By developing in this manner to a relatively low density the above-mentioned annoying diffraction phenomena are suppressed.

The best reproduction of the information copied in this manner is obtained when it is read in reflection. This require a reflective surface either in the form of a provision in the reproducing apparatus, or in the form of a coating on the copy of the information carrier, for example a vapour-deposited aluminium coating. When reading the copy the transparent portions will reflect the light substantially unweakened whereas the picture portions will absorb twice: once for the incident light and once for the reflected light.

In accordance with the invention it was found that with the photographic system known from United Kingdom Patent Specification No. 1,227,116 it is possible to obtain a copy in the form of an external picture pattern which can be read directly in reflection from above.

The conditions for obtaining the external picture by means of photographic systems whilst using a light-sensitive material, consisting of a support in which there is a light-sensitive compound of the type that can react with mercurous ions in the presence of moisture, and preferably, also in the presence of silver ions whilst separating mercury or silver amalgam which is deposited in the form of a physically developable nuclei image, are described in United Kingdom Patent Specification No. 954,208. Therein, however, the object was the production of printed wiring patterns in an additive manner, wherein the details are generally much greater than those of the information tracks in accordance with United Kingdom Patent Specification No. 1,391,541. As therein an external growth of metal takes place it has been assumed so far that the resolution was limited to fairly coarse details. However, it appeared possible to improve the resolution by means of special measures to such an extent that even submicron details can be depicted.

It is in the first place important that a nuclei image is obtained which is located at or at most near the surface of the carrier. This location can be controlled; it is determined by the diffusion rates (a) of the light reaction product and (b) of the ion of the nuclei image metal.

As the light reaction product of the benzene diazosulphides used is very diffusion-resistant the location can be influenced by varying the concentration of the reaction partners and by varying the nature of the indiffusing solvent. The concentration of the light reaction product is coupled with the intensity of the exposure. By means of a proper choice of the intensity of exposure, of the concentration of the nuclei image metal ion and of the nature of the solvent the depth of the nuclei image can be controlled. Thus, when using a hydrophilic carrier a solvent mixture consisting for at least 50 vol. % of water and for the remainder of a water-soluble organic solvent is chosen for the nuclei image metal ion or mixture of metal ions.

The nuclei image is allowed to grow by means of stabilized physical development until it grows out of the carrier. The external metal image obtained then has a nice reflective appearance.

In order to obtain an external image pattern which corresponds without loss in quality with the information track of the type discussed above and which is immediately readable in reflection the nuclei image should be at a distance of not more than 0.3 μm within the carrier surface or at the carrier surface.

It is then possible to obtain already a reflective image by a very small growth by means of physical development whereby the details of the image are preserved.

In accordance with the invention a copy of an information carrier of the type described above which is directly readable in reflection is obtained owing to the fact that use is made of a light-sensitive material consisting of a support containing a light-sensitive compound which is of the type that furnishes, after exposure, a light reaction product which is able to react with mercurous ions in the presence of silver ions whilst separating mercury or silver amalgam which is deposited in the form of a physically developable metal nuclei image, which light-sensitive compound is an aromatic diazosulphide of the structure

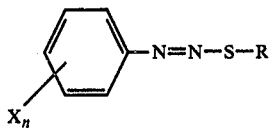

wherein the benzene ring may contain one or more substituents X and wherein R is a whether or not branched alkyl or aralkyl group, the intensity of the exposure and the concentration of the nuclei image metal ion being chosen so that the nuclei image is formed at a distance between 0 and 0.3 μm below the carrier surface, which nuclei image is subsequently developed with a stabilized developer until it has grown out of the carrier. The following example may serve to illustrate the invention:

Contact copies of chromium-on-glass masks comprising a test picture having lines narrower than 0.5 μm were reproduced in a pressure cassette at a pressure of 2 atm. on light-sensitive material by exposure for 9 seconds with a 125 W HPR high-pressure mercury lamp at a distance of 80 cm.

The light-sensitive material consisted of a 2 μm thick coating of saponified cellulose acetobutyrate on a 1.65 mm thick glass plate which material was made sensitive to light by treating it with a solution of 0.1 mole/l 3.5 dichloro-4-dimethylaminobenzenediazo-t-butylsulphide in ethanol. Another substrate, for axample a 1 mm thick methacrylate plate can be used instead of glass. A 120 μm thick superficially saponified cellulose triacetate film may also be used as starting material.

The exposed plate was immersed for 2 seconds in a solution which contained per liter of solvent (6 : 2 : 1 parts by volume of water-isopropanolethylacetate):

0.0025 mole $Hg_2(NO_3)_2$
0.025 mole $AgNO_3$
0.01 mole $HNO_3$

The nuclei image obtained was at a depth of 0.2 μm.

After rinsing for 2 seconds in the same solvent physical development took place for 20 seconds in a solution in water, containing per liter:

0.1 mole ferrous-ammoniumsulphate
0.04 mole ferric nitrate
0.05 mole citric acid
0.05 mole silver nitrate
0.008% "Armac 12 D"
0.008% "Lissapol N"

The reflection spectrum of these images was determined.

The maximum reflection appeared to be in the wave length range 500–550 nm. Half of the maximum reflection was found at 420 and 720 nm.

The result of the method is a copy which contains all details of the original and wherein the image is reflective.

Qualitatively the result is comparable with that obtained in accordance with the prior Dutch Patent Application 7,609,610 which has not yet been published.

"Armac 12 D" is a cationic wetting agent which consists for approximately 90% of dodecyl amineacetate, for approximately 9% of tetradecyl amineacetate and for the remainder of acetates of higher amines.

"Lissapol N" is a non-ionic wetting agent consisting of a condensation product of ethylene oxide and alkyl phenols.

What is claimed is:

1. A method of making copies of a carrier of video and/or audio information where the information is present in the form of blocks of variable length separated by areas of variable length all located in a single plane, said blocks of variable length and areas of variable length forming together an information track in the form of a spiral or of concentrical circles, said method comprising exposing to light, through a mask having the desired structure, a light-sensitive material comprising a support having thereon a layer containing as a light-sensitive compound an aromatic diazosulfide of the formula

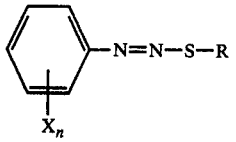

wherein R is alkyl or aralkyl, X is a substituent and $n$ is an integer from 0 to 5 inclusive, treating said exposed light-sensitive material with a water soluble mercury salt or a mixture of a water soluble mercury salt and a silver salt and moisture to form, with the light-reaction product of said light-sensitive compound, a physically developable nuclei metal image of mercury or of silver amalgam on the exposed areas of said light-sensitive material and then developing said light-sensitive material by treatment with a stabilized physical developer containing an aqueous solution of a metal salt, a reducing agent for said metal salt capable of causing said metal salt to deposit free metal on said nuclei metal image and a compound capable of preventing reduction in solution of said salt, the intensity of exposure of said light-sensitive material to light being so chosen that said nuclei image is formed at a distance between 0 and 0.3 μm below the surface of said layer and the time of development is of sufficient duration to cause said free metal deposition on the nuclei image to grow out of said layer.

* * * * *